US011074856B2

(12) United States Patent
Zhao et al.

(10) Patent No.: US 11,074,856 B2
(45) Date of Patent: Jul. 27, 2021

(54) DISPLAY PANEL AND DISPLAY DEVICE

(71) Applicant: WUHAN CHINA STAR OPTOELECTRONICS SEMICONDUCTOR DISPLAY TECHNOLOGY CO., LTD., Wuhan (CN)

(72) Inventors: Yong Zhao, Wuhan (CN); Zuomin Liao, Wuhan (CN); Tao Chen, Wuhan (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/637,814

(22) PCT Filed: Nov. 7, 2019

(86) PCT No.: PCT/CN2019/116124
§ 371 (c)(1),
(2) Date: Feb. 10, 2020

(87) PCT Pub. No.: WO2021/027109
PCT Pub. Date: Feb. 18, 2021

(65) Prior Publication Data

US 2021/0043135 A1 Feb. 11, 2021

(30) Foreign Application Priority Data

Aug. 9, 2019 (CN) ..... 201910736287.7

(51) Int. Cl.
*G09G 3/3225* (2016.01)
*G09G 3/3266* (2016.01)
*G09G 3/3275* (2016.01)

(52) U.S. Cl.
CPC ..... *G09G 3/3225* (2013.01); *G09G 3/3266* (2013.01); *G09G 3/3275* (2013.01)

(58) Field of Classification Search
CPC ... G09G 3/3225; G09G 3/3275; G09G 3/3266
See application file for complete search history.

(56) References Cited

U.S. PATENT DOCUMENTS

2014/0132158 A1* 5/2014 Land ..... G09G 3/20 315/152
2018/0130422 A1* 5/2018 Jeon ..... G09G 3/3275
2018/0197482 A1* 7/2018 Choi ..... G09G 3/3266
2019/0181213 A1* 6/2019 Lim ..... G09G 3/3266
2020/0193900 A1* 6/2020 Chen ..... G09G 3/20

* cited by examiner

*Primary Examiner* — Andrew Sasinowski

(57) ABSTRACT

The present application provides a display panel and a display device, the display panel makes a circuit structure of a first pixel driving circuit driving a first display pixel of a display transparent area to emit light different from a circuit structure of a second pixel driving circuit driving a second display pixel of a main display area to emit light, thereby reducing an area of a function add-on area occupied by the first pixel driving circuit, increasing an area of the display transparent area, improving light transmittance of the display transparent area, and improving photographing effect of under screen camera.

14 Claims, 6 Drawing Sheets

DISPLAY PANEL AND DISPLAY DEVICE

BACKGROUND OF INVENTION

Field of Invention

The present application relates to the display technology field, and particularly to a display panel and a display device.

Description of Prior Art

Due to extremely high screen ratio, full screen brings users a new visual experience and sensory impact, and has become the goal sought after by display panel manufacturers.

At present, digging a camera area of a display panel is a common design of under screen camera, and a light transmission area of a camera does not display images. This way provides relatively higher panel penetration rate, but user display experience is not good, and the full screen effect cannot be achieved. Another method is to set a display light transmission area on the display panel, and set the under screen camera at a position corresponding to the display light transmission area of the display panel, thereby improving user experience and becoming a target pursued by display panel manufacturers. However, with the adoption of such method, light transmittance of the display transparent area of the display panel is lower, so that photographing effect of the camera under the screen is poor.

In summary, it is necessary to provide a new display panel and a display device to solve the above technical problems.

SUMMARY OF INVENTION

The present application provides a display panel and a display device, which solves the technical problem that the light transmittance of the display light transmissive area of the display panel is low, so that the photographing effect of the camera under the screen is poor.

In order to solve the above problem, the technical solution provided by the present application is as follows:

The present application provides a display panel, the display panel comprises a main display area and at least one function add-on area, the at least one function add-on area comprises at least one display transparent area, a size of the at least one display transparent area ranges from 600-10000 um, a plurality of first display pixels are provided in the at least one display transparent area, a plurality of first pixel driving circuits are provided in the at least one function add-on area and correspond to a peripheral area of the at least one display transparent area, and at least one part of the first pixel driving circuits is configured to drive the first display pixels to emit light;

wherein a plurality of second display pixels and a plurality of second pixel driving circuits are provided in the main display area, and the second pixel driving circuits are configured to drive the second display pixels to emit light; and wherein circuit structures of the first pixel driving circuits are different from circuit structures of the second pixel driving circuits, so that an area of the at least one function add-on area occupied by the first pixel driving circuits is less than an area of the main display area occupied by the second pixel driving circuits.

In the display panel of the present application, an area of the first pixel driving circuits is less than an area of the second pixel driving circuits, and/or a wiring space of the first pixel driving circuits is less than a wiring space of the second pixel driving circuits.

In the display panel of the present application, a number of components of the first pixel driving circuits is less than a number of components of the second pixel driving circuits.

In the display panel of the present application, wherein components of the second pixel driving circuits comprise seven thin film transistors, a storage capacitor, and a light emitting element; and wherein components of the first pixel driving circuits comprise two thin film transistors, a storage capacitor, and a light emitting element, or the components of the first pixel driving circuits comprise four thin film transistors, a storage capacitor, and a light emitting element, or the components of the first pixel driving circuits comprise six thin film transistors, a storage capacitor, and a light emitting element.

In the display panel of the present application, a size of the first pixel driving circuits is less than a size of the second pixel driving circuits.

In the display panel of the present application, components of the second pixel driving circuits comprise seven thin film transistors, a storage capacitor, and a light emitting element, and components of the first pixel driving circuits comprise seven thin film transistors, a storage capacitor, and a light emitting element.

In the display panel of the present application, a plurality of signal traces are disposed in the peripheral area of the at least one display transparent area and in the at least one functional additional area, and the signal traces are electrically connected to the first pixel driving circuits, wherein at least two first pixel driving circuits share at least one signal trace and are symmetrical about the at least one signal trace.

In the display panel of the present application, the signal traces comprise power signal lines, and the at least two first pixel driving circuits share one power signal line and are symmetrical about the power signal line.

The present application provides a display panel, the display panel comprises a main display area and at least one functional additional area, the at least one function add-on area comprises at least one display transparent area, a plurality of first display pixels are provided in the at least one display transparent area, a plurality of first pixel driving circuits are provided in the at least one function add-on area and correspond to a peripheral area of the at least one display transparent area, and at least one part of the first pixel driving circuits is configured to drive the first display pixels to emit light;

wherein a plurality of second display pixels and a plurality of second pixel driving circuits are provided in the main display area, and the second pixel driving circuits are configured to drive the second display pixels to emit light; and wherein circuit structures of the first pixel driving circuits are different from circuit structures of the second pixel driving circuits, so that an area of the at least one function add-on area occupied by the first pixel driving circuits is less than an area of the main display area occupied by the second pixel driving circuits.

In the display panel of the present application, an area of the first pixel driving circuits is less than an area of the second pixel driving circuits, and/or a wiring space of the first pixel driving circuits is less than a wiring space of the second pixel driving circuits.

In the display panel of the present application, a number of components of the first pixel driving circuits is less than a number of components of the second pixel driving circuits.

In the display panel of the present application, components of the second pixel driving circuits comprise seven thin film transistors, a storage capacitor, and a light emitting element; and wherein components of the first pixel driving circuits comprise two thin film transistors, a storage capacitor, and a light emitting element, or the components of the first pixel driving circuits comprise four thin film transistors, a storage capacitor, and a light emitting element, or the components of the first pixel driving circuits comprise six thin film transistors, a storage capacitor, and a light emitting element.

In the display panel of the present application, a size of the first pixel driving circuits is less than a size of the second pixel driving circuits.

In the display panel of the present application, components of the second pixel driving circuits comprise seven thin film transistors, a storage capacitor, and a light emitting element, and components of the first pixel driving circuits comprise seven thin film transistors, a storage capacitor, and a light emitting element In the display panel of the present application, a plurality of signal traces are disposed in the peripheral area of the at least one display transparent area and in the at least one functional additional area, and the signal traces are electrically connected to the first pixel driving circuits, wherein at least two first pixel driving circuits share at least one signal trace and are symmetrical about the at least one signal trace.

In the display panel of the present application, the signal traces comprise power signal lines, and the at least two first pixel driving circuits share one power signal line and are symmetrical about the power signal line.

In the display panel of the present application, the first display pixels comprise a first pixel anode, and at least one transparent trace is provided in the at least one display transparent area, wherein the at least one transparent trace is electrically connected to the first pixel anode and the first pixel driving circuits, so that at least part of the first pixel driving circuits is configured to drive the first display pixels to emit light.

In the display panel of the present application, the first pixel anode is electrically connected to the first pixel driving circuits by at least one part of the at least one transparent trace provided in the at least one display transparent area, and at least another part of the at least one transparent trace provided in the peripheral area of the at least one display transparent area and in the at least one functional additional area.

In the display panel of the present application, the first pixel anode is electrically connected to the first pixel driving circuits by at least one part of the at least one transparent trace provided in the main display area, and at least another part of the at least one transparent trace provided in the peripheral area of the at least one display transparent area and in the at least one functional additional area.

The present application provides a display device, the display device comprises the display panel of the above; and a photosensitive element, wherein the photosensitive element is disposed at one side of the display panel and corresponds to the at least one functional additional area.

The benefit is: the present application provides a display panel and a display device, a circuit structure of a first pixel driving circuit driving a first display pixel of a display transparent area to emit light is different from a circuit structure of a second pixel driving circuit driving a second display pixel of a main display area to emit light, a compound number, a size, and a wiring space of the first pixel driving circuit is reduced, thereby increasing an area of the display transparent area, improving light transmittance the display transparent area, and improving photographing effect of the camera under the screen.

BRIEF DESCRIPTION OF DRAWINGS

In order to more clearly illustrate the technical solutions in the present application, the drawings used in the description of the embodiments will be briefly described below. It is obvious that the drawings in the following description are only some embodiments of the present application, and those skilled in the art can also obtain other drawings based on these drawings without making creative effort.

DETAILED DESCRIPTION OF PREFERRED EMBODIMENTS

Figure 1:
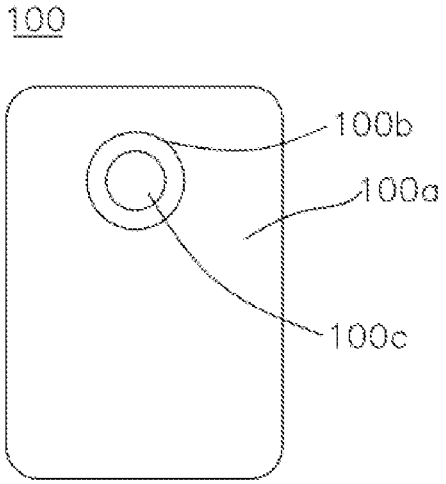
FIG. 1 is a structural schematic diagram of a display panel of an embodiment according to the present application.

The following description of the various embodiments is provided to illustrate the specific embodiments of the invention. Directional terms mentioned in the present invention, such as "upper", "lower", "previous", "post", "left", "right", "inside", "outside", "side", etc., are merely references to the direction of the appended drawings. Therefore, the directional terminology used is for the purpose of illustration and understanding of the invention. In the figures, structurally similar elements are denoted by the same reference numerals.

The present application is directed to problems of a poor photographing effect of a camera under a screen caused by a low display light transmittance of a display transparent area, and the present embodiment can solve this defect.

Referring to FIG. 1, a display panel 100 of the present application is an active matrix OLED display panel. The display panel 100 includes a main display area 100*a* and at least one function add-on area 100*b*. The main display area

100*a* is mainly configured to be a display image area. The function add-on area 100*b* is configured to dispose photosensitive elements. The function add-on area 100*b* has at least one display transparent area 100*c* of therein. The display transparent area 100*c* is configured to display image and transmit light to allow the photosensitive elements placed at one side of the display panel 100 and corresponding to the display transparent area 100*c* to receive light signals. The photosensitive element can be a camera, an optical touch component, a fingerprint recognition sensor, etc., so that the display panel can implement functions such as a photographing function, an optical touch function, an optical fingerprint recognition, etc.

Figure 2:
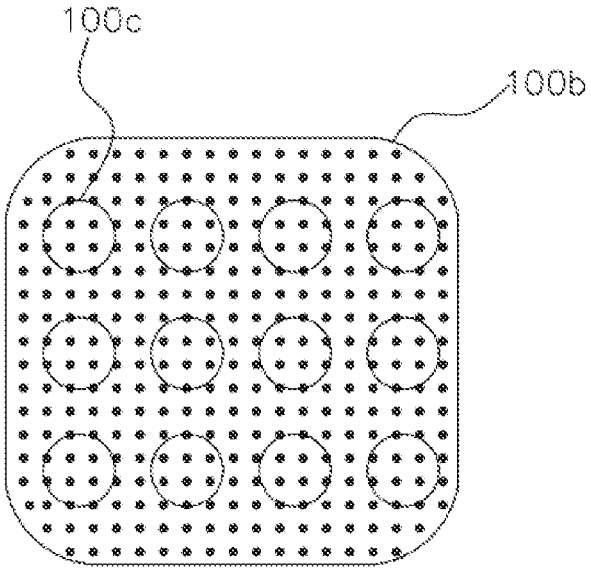
FIG. 2 is a structural schematic diagram of a function add-on area of an embodiment according to the present application.

Referring to FIG. 2, the function add-on area 100*b* can have a plurality of display transparent areas 100*c* defined therein. The display transparent area 100*c* can be a circle, a rectangle, a rounded rectangle, or an irregular polygon. A size of each display transparent area 100*c* is 0.36 $mm^2$-100 $mm^2$ to ensure the camera having good photographing effect and reduce process difficulty when the camera is correspondingly disposed in the function add-on area 100*b* of the display panel 100.

It should be noted, in order to facilitate the description of the technical solution of the embodiment of the present application, the present application uses an embodiment to explain, which is that the display panel 100 has a function add-on area 100*b*, and the function add-on area 100*b* has a display transparent area 100*c*.

Since pixel driving circuits of the display panel 100 includes a plurality of metal film layers, such as a polysilicon layer, a controlling electrode layer, a source and drain electrode metal layer, and so on, and the metal film layer has a light shielding effect, areas where the pixel driving circuits are disposed corresponding to the display panel 100 are not translucent. Moreover, the metal film layers have reflection, diffraction, interference, and the like on the light; hence, the pixel driving circuits are placed outside of the display transparent area 100*c* to allow the display transparent area 100*c* to not be occupied by the pixel driving circuits and thus have good light transmittance.

Figure 3:
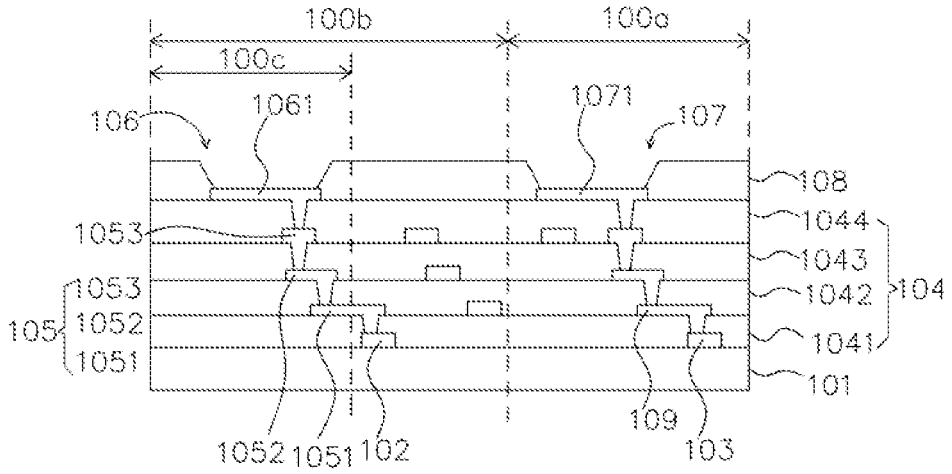
FIG. 3 is a cross sectional structural schematic diagram of a display panel of an embodiment according to the present application.

Referring to FIG. 3, the display panel 100 includes a substrate 101, a plurality of first pixel driving circuits 102, a plurality of second pixel driving circuits 103, at least two insulating layers 104, a plurality of transparent traces 105, a plurality of first display pixels 106, a plurality of second display pixels 107, and a plurality of signal traces.

The first pixel driving circuits 102 are formed in the function add-on area 100*b* of the substrate 101 and outside of the display transparent area 100*c*. The first display pixels 106 are formed on one side of the insulating layers 104 away from the substrate 101 and in the display transparent area 100*c*. At least one part of the first pixel driving circuits 102 drive the first display pixels 106 to emit light. The first display pixels 106 include first pixel anodes 1061. The second display pixels 107 are formed on one side of the insulating layers 104 away from the substrate 101 and in the main display area 100*a*. The substrate 101 located in the main display area 100*a* has the second pixel driving circuits 103 formed therein to drive the second display pixels 107 to emit light. One second pixel driving circuit 103 is formed under each sub pixel constituting the second display pixels 107. The second display pixels 107 include second pixel anodes 1071.

The display panel 100 further includes a pixel defining layer 108. The pixel defining layer 108 covers the first pixel anodes 1061, the second pixel anodes 1071, and the insulating layers 104.

The function add-on area 100*b* has a plurality of transparent traces 105 formed therein. The first display pixels 106 are electrically connected to the first pixel driving circuits 102 by the transparent traces 105. The transparent traces 105 include at least two layers of the transparent traces 105 located in different layers. In the present application, the transparent traces 105 are three layers, the transparent traces 105 include first transparent traces 1051, second transparent traces 1052, and third transparent traces 1053. The first transparent traces 1051, the second transparent traces 1052, and the third transparent traces 1053 are respectively located in different layers. Specifically, a distance between each two adjacent transparent traces 105 located in a same layer is greater than 2 μm to prevent a short circuit caused in the two adjacent transparent traces 105 located in the same layer. A line width of the transparent traces 105 is greater than 1 μm to prevent an open circuit caused in the transparent traces 105 due to an insufficient line width.

In one embodiment, the first display pixels 106 are electrically connected to the first pixel driving circuits 102 by at least one part the transparent traces 105 located in the main display area 100*a* and located outside of the main display area 100*a* and in the function add-on area 100*b*, that is, the transparent traces 105 are mainly located in the display transparent area 100*c*.

One part of the first display pixels 106 of the plurality of first display pixels 106 are electrically connected to the first pixel driving circuits 102 by one layer, two layers, or three layers of the transparent traces 105. In this embodiment, the first display pixels 106 are electrically connected to the first pixel driving circuits 102 by three layers of the transparent traces 105.

Continuing, refer to FIG. 3, the insulating layers 104 have four layers, and include a first insulating layer 1041, a second insulating layer 1042, a third insulating layer 1043, and a fourth insulating layer 1044. The first insulating layer 1041 covers the first pixel driving circuits 102 and the second pixel driving circuits 103. The first transparent traces 1051 are formed on the first insulating layer 1041. At least one part of the first transparent traces 1051 is located in the function add-on area 100*b*, and the other part is located in the display transparent area 100*c*. The second insulating layer 1042 covers the first insulating layer 1041 and the first transparent traces 1051. The second transparent traces 1052 are formed on the first insulating layer 1041. The second transparent traces 1052 are located in the display transparent area 100*c*. The third insulating layer 1043 covers the first insulating layer 1041 and the second transparent traces 1052. The third transparent traces 1053 are formed on the third insulating layer 1043. The third transparent traces 1053 are located in the display transparent area 100*c*. The fourth insulating layer 1044 covers the third insulating layer 1043 and the third transparent traces 1053. The first pixel anodes 1061 are formed on the fourth insulating layer 1044 located in the display transparent area 100*c*. The second pixel anodes 1071 are formed on the fourth insulating layer 1044 located in the main display area 100*a*. The first pixel anodes 1061 are electrically connected to the first pixel driving circuits 102 by the third transparent traces 1053, the second transparent traces 1052, and the first transparent traces 1051. Two adjacent transparent traces are connected to each other by through holes defined in the insulating layers.

Further, orthographic projections of the first transparent traces 1051, the second transparent traces 1052, and the third transparent traces 1053 are at least partly coincided with each other on the substrate 101. By adopting such a laminated wiring method, it is advantageous to increase the number of the transparent traces 105, thereby increasing an area of the display transparent area 100*c* to improve the light transmittance thereof.

In one embodiment, the first pixel anodes 1061 are electrically connected to the first pixel driving circuits 102 by at least one part of the transparent traces 105 located in the main display area 100*a* and least one part of the transparent traces 105 located in the function add-on area 100*b*, that is, the transparent traces 105 can be simultaneously formed in the main display area 100*a* to electrically connect to the first pixel driving circuits 102 and the first pixel anodes 1061, thereby increasing a wiring space of the transparent traces 105 and preventing short circuit caused by an insufficient distance between two adjacent transparent traces 105 located in a same layer.

Figure 4:
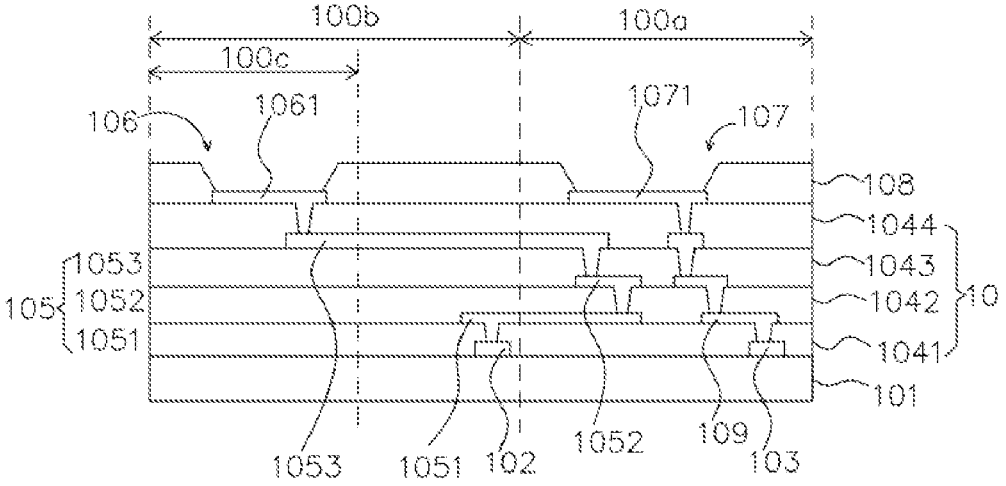
FIG. 4 is a cross sectional structural schematic diagram of another display panel of an embodiment according to the present application.

Referring to FIG. 4, the difference between FIG. 4 and FIG. 3 is as follows: the first transparent traces 1051 are formed on the first insulating layer 1041, at least one part of the first transparent traces 1051 is located in the function add-on area 100*b*, the other part of the first transparent traces 1051 extends from the function add-on area 100*b* to the main display area 100*a*; the second insulating layer 1042 covers the first insulating layer 1041 and the first transparent traces 1051, the second transparent traces 1052 are formed on the second insulating layer 1042, the second transparent traces 1052 are located in the main display area 100*a*; the third insulating layer 1043 covers the second insulating layer 1042 and the second transparent traces 1052, the second transparent traces 1052 extent from the main display area 100*a* through the function add-on area 100*b* to the display transparent area 100*c*; the fourth insulating layer 1044 covers the third insulating layer 1043 and the third transparent traces 1053; and the first pixel anodes 1061 are electrically connected to the first pixel driving circuits 102 successively by the third transparent traces 1053, the second transparent traces 1052, and the first transparent traces 1051.

It is understood that a part of the first pixel anodes 1061 of the first display pixels 106 near the main display area 100*a* is electrically connected to the first pixel driving circuits 102 by at least one part of the transparent traces 105 located in the main display area 100*a* and at least one part of the transparent traces 105 located outside of the display transparent area 100*c* and in the function add-on area 100*b*; a part of the first pixel anodes 1061 of the first display pixels 106 far from the main display area 100*a* is electrically connected to the first pixel driving circuits 102 by at least one part of the transparent traces 105 located in the display transparent area 100*c* and at least one part of the transparent traces 105 located outside of the display transparent area 100*c* and in the function add-on area 100*b*, thereby reducing the wiring space of the transparent traces 105 and increasing the number of the transparent traces 105.

A plurality of signal traces are formed on the substrate 101 located in the function add-on area 100*b* and outside of the display transparent area 100*c*, and are configured to transmit signals for driving the first display pixels 106 to the first pixel anodes 1061. Since the signal traces have a shading effect, the signal traces are formed outside of the display transparent area 100*c* to improve the light transmittance performance of the display transparent area 100*c* without the signal traces.

Specifically, the signal traces can include a plurality of first signal traces and a plurality of second signal traces, the first signal traces can include scanning lines, light emitting signal lines controlling the first display pixels 106 to emit light, and reset lines controlling the first pixel anodes 1061 to reset; the second signal traces can includes data lines configured to transmit data voltage driving the first display pixels 106.

Specifically, an area of the function add-on area 100*b* occupied by the first pixel driving circuits 102, the signal traces and the first pixel anodes 1061 is less than or equal to 50%, an area of the display transparent area 100*c* occupied by the first pixel anodes 1061 is less than 50%, thereby ensuring the display transparent area 100*c* having a sufficient light transmission area. In the embodiment of the present invention, a size of the display transparent area 100*c* is 600-10000 μm.

Further, referring to FIGS. 3 and 4, the display panel 100 further includes a conductive layer 109 formed between at least two insulating layers 104, the conductive layer 109 is located in the main display area 100*a*, the second pixel anodes 1071 of the second display pixels 107 are electrically connected to the second pixel driving circuits 103 by the conductive layer 109 to allow the second pixel driving circuits 103 to drive the second display pixels 107 to emit light and increase electrical conductivity. It should be noted that wiring manners and materials of the conductive layer 109, and electrically connecting manners of the second pixel anodes 1071 and the second pixel driving circuits 103 are the same as the transparent traces 105, and can be manufactured by a process as same as the transparent traces 105, thereby saving the process steps and reducing the production cost. For details, refer to the foregoing embodiments, and details are not described herein again.

Further, an area of the function add-on area 100*b* occupied by the first pixel driving circuits 102 and the signal traces will affect a size of the display transparent area 100*c*. Specifically, when the area of the function add-on area 100*b* occupied by the first pixel driving circuits 102 and the signal traces is greater, the size of the display transparent area 100*c* is smaller; and when the area of the function add-on area 100*b* occupied by the first pixel driving circuits 102 and the signal traces is smaller, the size of the display transparent area 100*c* is greater. So, in this embodiment, the first pixel driving circuits 102 and the second pixel driving circuits 103 adopt different circuit structures, so that an area of the function add-on area 100*b* occupied by the first pixel driving circuits 102 is less than an area of the main display area 100*a* occupied by the second pixel driving circuits 103, thereby increasing the size of the display transparent area 100*c*.

Different circuit structures can be expressed in terms of device areas and wiring structures, so device areas and wiring structures of the first pixel driving circuits 102 can be adjusted to make the circuit structures of the first pixel driving circuits 102 different from the circuit structures of the second pixel driving circuits 103, thereby leaving a necessary space for the display transparent area 100*c*. The embodiment of the present application will be described in terms of the above two aspects.

In one embodiment, the device area of the first pixel driving circuits 102 is less than the device area of the second pixel driving circuits 103, wherein the device area is mainly decided by a number of devices and sizes of the devices. The devices of the first pixel driving circuits 102 and the second pixel driving circuits 103 are mainly defined as thin film transistor devices and storage capacitor constituting the first pixel driving circuits 102 and the second pixel driving circuits 103.

The device number of the first pixel driving circuits 102 is less than the device number of the second pixel driving circuits 103. In one embodiment of the present application, the second pixel driving circuits 103 configured for driving the second display pixels 107 of the main display area 100*a* to emit light adopt a 7T1C circuit, the 7T1C circuit includes seven thin film transistors and a storage capacitor. The first pixel driving circuits 102 configured for driving the first display pixels 106 of the display transparent area 100*c* to emit light can adopt any one of a 2T1C circuit, a 4T1C circuit, or a 6T1C circuit; in other embodiments, the second pixel driving circuits 103 can adopt a 4T1C circuit or a 6T1C circuit. Specifically, when the second pixel driving circuits 103 adopt a 4T1C circuit, the first pixel driving circuits 102 can adopt a 2T1C circuit; when the second pixel driving circuits 103 adopt a 6T1C circuit, the first pixel driving circuits can adopt a 2T1C circuit or a 4T1C circuit. In order to clearly explain the technical solution of the present application, in the embodiment of the present application, the second pixel driving circuits 103 adopt a 7T1C circuit as an example for explanation.

Figure 5A:
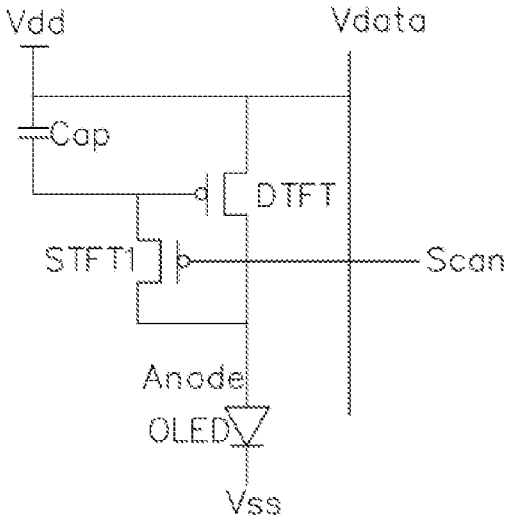
FIG. 5A is a structural schematic diagram of a 2T1C circuit structure of a first pixel driving circuit of an embodiment according to the present application.

For example, referring to FIG. 5A, the first pixel driving circuits 102 adopt a 2T1C circuit, the 2T1C circuit includes two thin film transistors and a storage capacitor, the two thin film transistors include a driving thin film transistor DTFT and a first switch thin film transistor STFT1, a controlling electrode of the first switch thin film transistor STFT1 is electrically connected to a scanning line Scan, a first electrode of the first switch thin film transistor STFT1 is electrically connected to a first electrode of the driving thin film transistor DTFT and an anode electrode of a light emitting element, a second electrode of the first switch thin film transistor STFT1 is electrically connected to a controlling electrode of the driving thin film transistor DTFT and a first end of the storage capacitor Cap; a second electrode of the driving thin film transistor DTFT is electrically connected to a second end of the storage capacitor Cap and a data line; a second end of the storage capacitor Cap is electrically connected to a first power signal line Vdd; and a cathode electrode of the light emitting element is electrically connected to a second power signal line Vss.

Figure 6A:
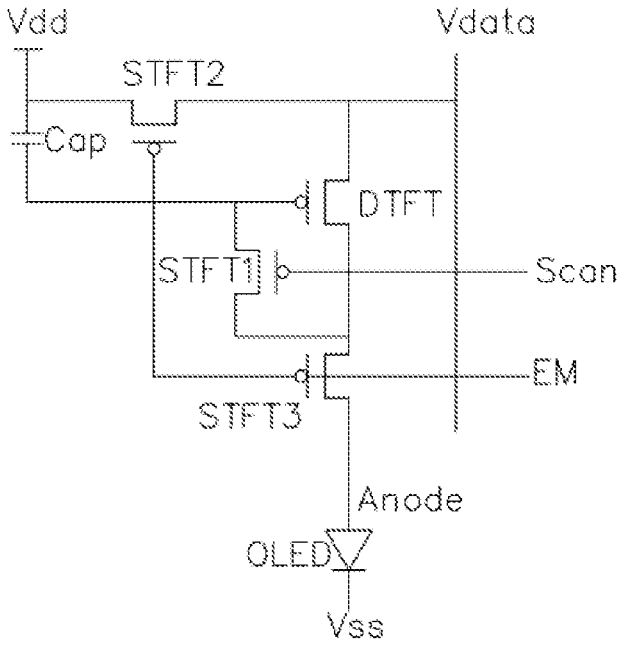
FIG. 6A is a structural schematic diagram of a 4T1C circuit structure of a first pixel driving circuit of an embodiment according to the present application.

For example, referring to FIG. 6A, the first pixel driving circuits 102 adopt a 4T1C circuit, the 4T1C circuit includes four thin film transistors and a storage capacitor Cap, the four thin film transistors include a driving thin film transistor DTFT, a first switch thin film transistor STFT1, a second switch thin film transistor STFT2, and a third switch thin film transistor STFT3, a controlling electrode of the of the first switch thin film transistor STFT1 is electrically connected to the scanning line Scan, a first electrode of the first switch thin film transistor STFT1 is electrically connected to a first electrode of the driving thin film transistor DTFT and a second electrode of the third switch thin film transistor STFT3, a second electrode of the first switch thin film transistor STFT1 is electrically connected to a controlling electrode of the driving thin film transistor DTFT and a first end of the storage capacitor Cap; a controlling electrode of the second switch thin film transistor STFT2 is electrically connected to a controlling electrode of the third switch thin film transistor STFT3, a first electrode of the second switch thin film transistor STFT2 is electrically connected to a second electrode of the driving thin film transistor DTFT and a data line Data, a second electrode of the second switch thin film transistor STFT2 is electrically connected to a second end of the storage capacitor Cap, the controlling electrode of the third switch thin film transistor STFT3 is electrically connected to a controlling signal line EM, the second electrode of the third switch thin film transistor STFT3 is electrically connected to an anode electrode of a light emitting element; a second electrode of the driving thin film transistor DTFT is electrically connected to the data line Data; a second end of the storage capacitor Cap is electrically connected to a first power signal line Vdd; and a cathode electrode of a light emitting element is electrically connected to a second power signal line Vss.

A size of the first pixel driving circuits 102 is less than a size of the second pixel driving circuits 103, a size of the thin film transistors and the storage capacitor adopted in the first pixel driving circuits 102 is less than a size of the thin film transistors and the storage capacitor adopted in the second pixel driving circuits 103, thereby making an area of the first pixel driving circuits 102 less than an area of the second pixel driving circuits 103.

Figure 7A:
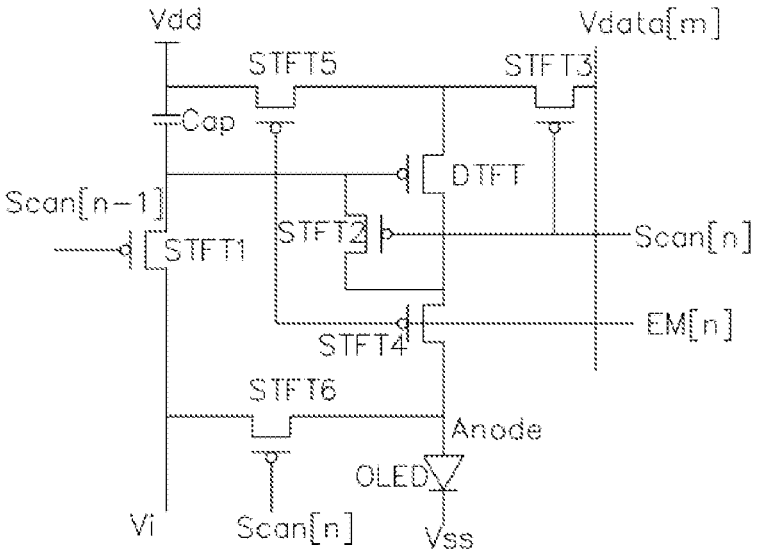
FIG. 7A is a structural schematic diagram of a 7T1C circuit structure of a first pixel driving circuit of an embodiment according to the present application.

It should be noted that in this situation, a circuit structure of the first pixel driving circuits 102 adopted can be same as a circuit structure of the second pixel driving circuits 103 adopted; for example, both circuit structures of the first pixel driving circuits 102 and the second pixel driving circuits 103 adopt 7T1C circuits. Referring to FIG. 7A, the first pixel driving circuits 102 include seven thin film transistors and a storage capacitor Cap, the seven thin film transistors include a driving thin film transistor DTFT, a first switch thin film transistor STFT1, a second switch thin film transistor STFT2, a third switch thin film transistor STFT3, a fourth switch thin film transistor STFT4, a fifth switch thin film transistor STFT5, and a sixth switch thin film transistor STFT6. A controlling electrode of the first switch thin film transistor STFT1 is electrically connected to a first scanning line Scan[n−1], a first electrode of the first switch thin film transistor STFT1 is electrically connected to a first electrode of the sixth switch thin film transistor STFT6 and a reset signal line Vi, a second electrode of the first switch thin film transistor STFT1 is electrically connected to a controlling electrode of the driving thin film transistor DTFT and a first end of the storage capacitor Cap; a controlling electrode of the second switch thin film transistor STFT2 is electrically connected to a controlling electrode of the third switch thin film transistor STFT3 and a second scanning line Scan[n], a first electrode of the second switch thin film transistor STFT2 is electrically connected to a first electrode of the driving thin film transistor DTFT and a second electrode of the fourth switch thin film transistor STFT4, a second electrode of the second switch thin film transistor STFT2 is electrically connected to the controlling electrode of the driving thin film transistor DTFT and the first end of the storage capacitor Cap; the controlling electrode of the third switch thin film transistor STFT3 is electrically connected to the controlling electrode of the second switch thin film transistor STFT2, a first electrode of the third switch thin film transistor STFT3 is electrically connected to a second electrode of the driving thin film transistor DTFT, a second electrode of the third switch thin film transistor STFT3 is electrically connected to the data line Data; a controlling electrode of the fourth switch thin film transistor STFT4 is electrically connected to a controlling electrode of the fifth switch thin film transistor STFT5 and a controlling signal line EM[n], a first electrode of the fourth switch thin film transistor STFT4 is electrically connected to an anode electrode of the light emitting element; a first electrode of the fifth switch thin film transistor STFT5 is electrically connected to the second electrode of the third switch thin film transistor STFT3 and the second electrode of the driving thin film transistor DTFT, a second electrode of the fifth switch thin film transistor STFT5 is electrically connected to a second end of the storage capacitor Cap, a controlling electrode of the sixth switch thin film transistor STFT6 is electrically connected to the second scanning lines Scan[n], the first electrode of the sixth switch thin film transistor STFT6 is electrically connected to the anode electrode of the light emitting element, the second electrode of the sixth switch thin film transistor STFT6 is electrically connected to the reset signal line Vi and the second electrode of the first switch thin film transistor STFT1, the second end of the storage capacitor Cap is electrically connected to a first power signal line Vdd; and a cathode electrode of the light emitting element is electrically connected a second power signal line Vss.

It should be noted that the light emitting element is an active matrix organic light emitting diode.

In one embodiment, a wiring space of the first pixel driving circuits 102 is less than a wiring space of the second pixel driving circuits 103, by compressing an occupied space of the signal lines and the devices of the first pixel driving circuits 102 and changing a positional relationship between the signal lines and the devices, the structure of the first pixel driving circuits 102 becomes more compact, thereby leaving a necessary space for the display transparent area 100*c*.

Further, at least two first pixel driving circuits 102 share at least one signal trace, the signal trace can include a scanning line Scan, a data line Data, a controlling signal line EM, a reset signal line Vi, a first power signal line Vdd, and a second power signal line Vss.

In one embodiment of the present application, at least two first pixel driving circuits 102 share one first power signal line Vdd, at least two first pixel driving circuits 102 are located at two sides of the first power signal line Vdd and symmetrical about each other, thereby reducing a wiring space of the first pixel driving circuits 102 and increasing a size of the display transparent area 100*c*.

Figure 5B:
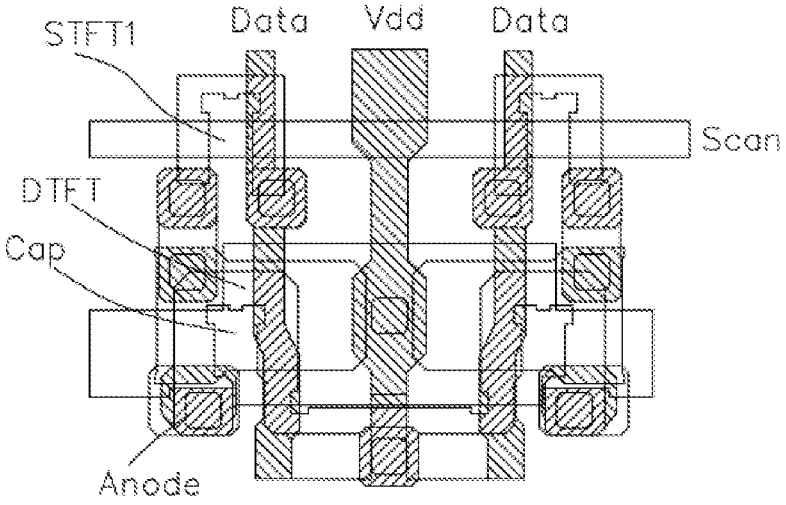
FIG. 5B is a wiring structural diagram of the 2T1C circuit structure of the first pixel driving circuit of the embodiment according to the present application.

Specifically, FIG. 5B is a wiring structural diagram of a 2T1C circuit structure of a first pixel driving circuit 102. The two first pixel driving circuits 102 share one first power signal line Vdd, the driving thin film transistors DTFT, the first switch thin film transistors STFT1, the storage capacitors Cap, the light emitting elements, and the data lines Data of the two first pixel driving circuits 102 are located at two sides of the first power signal line Vdd and symmetrical about each other.

Figure 6B:
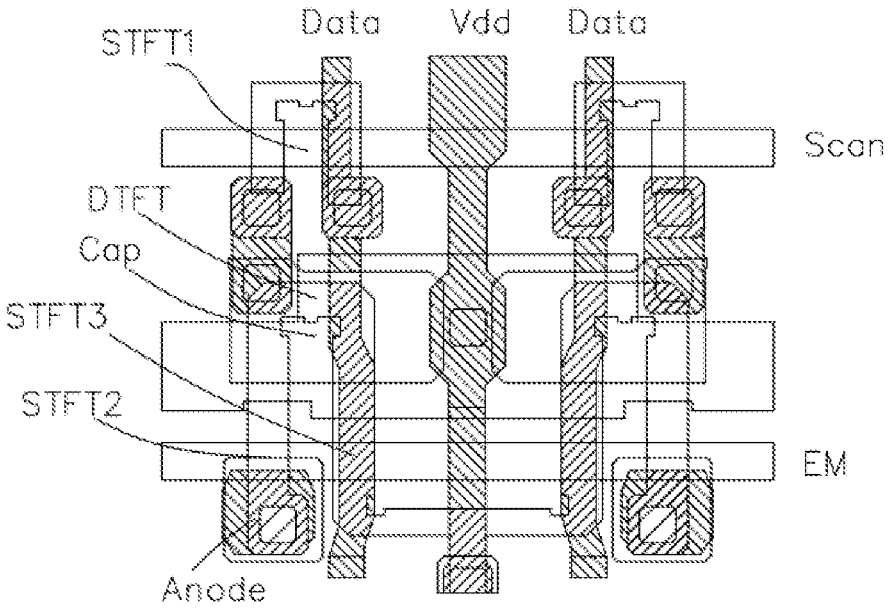
FIG. 6B is a wiring structural diagram of the 4T1C circuit structure of the first pixel driving circuit of the embodiment according to the present application.

FIG. 6B is a wiring structural diagram of a 4T1C circuit structure of a first pixel driving circuit 102. Two first pixel driving circuits 102 share one first power signal line Vdd, the driving thin film transistors DTFT, the first switch thin film transistors STFT1, the second switch thin film transistors STFT2, the third switch thin film transistors STFT3, the storage capacitors Cap, the light emitting elements, and the data lines Data of the two first pixel driving circuits 102 are located at two sides of the first power signal line Vdd and symmetrical about each other.

Figure 7B:
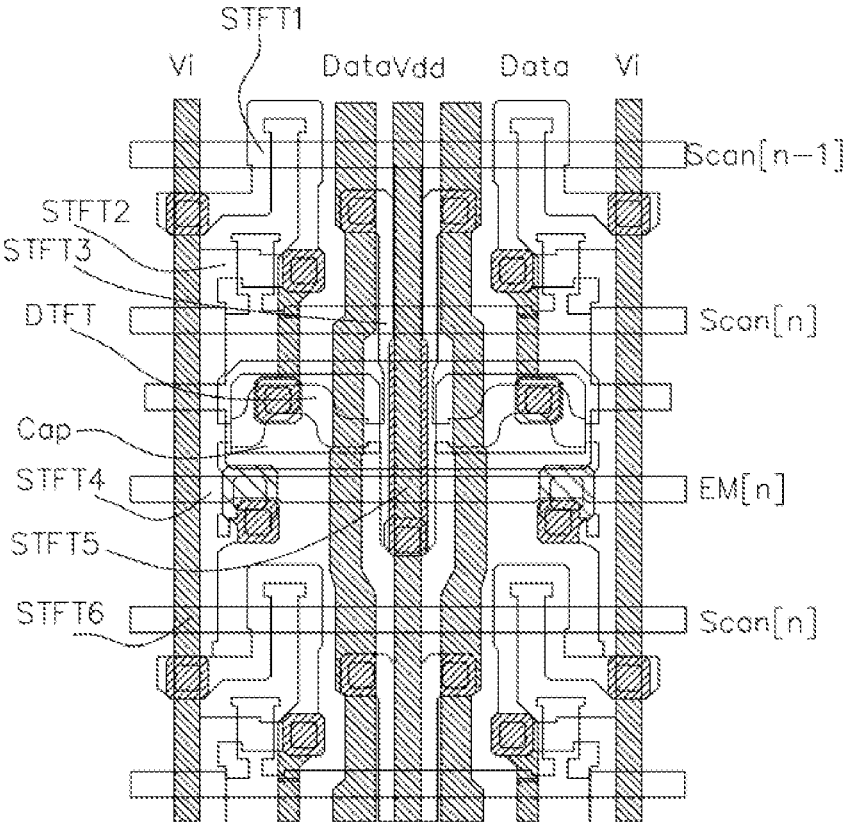
FIG. 7B is a wiring structural diagram of the 7T1C circuit structure of the first pixel driving circuit of the embodiment according to the present application.

FIG. 7B is a wiring structural diagram of a 7T1C circuit structure of a first pixel driving circuit 102. Two first pixel driving circuits 102 share one first power signal line Vdd, the driving thin film transistors DTFT, the first switch thin film transistors STFT1, the second switch thin film transistors STFT2, the third switch thin film transistors STFT3, the fourth switch thin film transistors STFT4, the fifth switch thin film transistors STFT5, the storage capacitors Cap, the light emitting elements, and the data lines Data of the two first pixel driving circuits 102 are located at two sides of the first power signal line Vdd and symmetrical about each other.

It should be noted that the transistors used in the embodiments of the present application can be thin film transistors, field effect transistors, or other devices having the same characteristics. Since the source and the drain of the thin film transistors used herein are symmetrical, there is no difference between the source and the drain. In order to distinguish the two electrodes of the thin film transistors except the controlling electrode which is the gate electrode, one of the two electrodes is defined as a source and the other electrode is defined as a drain. In addition, according to the characteristics of the thin film transistors, the thin film transistors can be divided into N-type thin film transistors or P-type thin film transistors, and the type of components in the pixel circuits can be flexibly selected according to the situation. In the embodiment of the present application, all of the thin film transistors can be P-type thin film transistors; or, all of the thin film transistors can be N-type thin film transistors; or, some of the thin film transistors are N-type thin film transistors, and some of the thin film transistors are P-type thin film transistors. It is easy to understand that when N-type thin film transistors are used, the first electrode can be a source, and the second electrode can be a drain; and when P-type thin film transistor are used, the first electrode can be a drain, and the second electrode can be a source.

Figure 8:
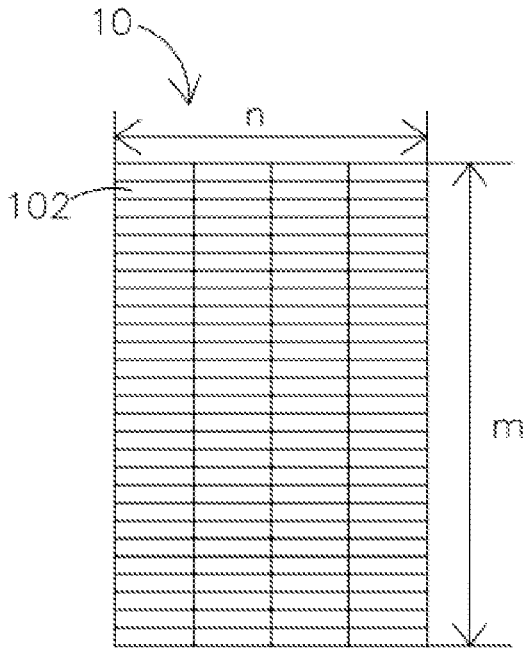
FIG. 8 is a structural schematic diagram of a pixel driving circuit island of an embodiment according to the present application.

Further, referring to FIG. 8, a plurality of the first pixel driving circuits 102 may be gathered together to form a pixel driving circuit island 10, each pixel driving circuit island 10 includes a plurality of the first pixel driving circuits 102. It is understood that each pixel driving circuit island 10 is formed by gathering a plurality of the first pixel driving circuits 102, and the concentrated gathering corresponds to the dispersive pixel driving circuit, and thereby increasing a size of the display transparent area 100*c*.

Specifically, each pixel driving circuit island 102 includes m×n first pixel driving circuits 102 with an array arrangement, wherein m is defined as the number of rows of the first pixel driving circuits 102, n is defined as the number of columns of the first pixel driving circuits 102, m and n are positive integers, and at least one of m or n is greater than 1; m is greater than or equal to 3 and less than 128, and n is greater than or equal to 1 and less than 128. Further, m is greater than or equal to 3 and less than 64, and n is greater than or equal to 1 and less than 64.

The present application also provides a display device, the display device includes the above display panel 100 and a photosensitive element, the photosensitive element is formed at one side of the display panel 100 and corresponds to the function add-on area 100*b*, and the photosensitive element can be a camera or an optical touch component.

The benefit is: the present application provides a display panel and a display device, a circuit structure of a first pixel driving circuit driving a first display pixel of a display transparent area to emit light is different from a circuit structure of a second pixel driving circuit driving a second display pixel of a main display area to emit light, a compound number, a size, and a wiring space of the first pixel driving circuit is reduced, thereby increasing an area of the display transparent area, improving light transmittance the display transparent area and improving photographing effect of the camera under the screen.

In summary, the present invention has been disclosed in the above preferred embodiments, but the preferred embodiments are not intended to limit the present invention, and those skilled in the art can make various modifications without departing from the spirit and scope of the invention. The invention can be modified or retouched, but the scope of the invention is defined by the scope defined by the claims.

What is claimed is:

1. A display panel, wherein the display panel comprises a main display area and at least one function add-on area, the at least one function add-on area comprises at least one display transparent area, a size of the at least one display transparent area ranges from 600-10000 um, a plurality of first display pixels are provided in the at least one display transparent area, a plurality of first pixel driving circuits are provided in the at least one function add-on area and correspond to a peripheral area of the at least one display transparent area, and at least one part of the first pixel driving circuits is configured to drive the first display pixels to emit light;

wherein a plurality of second display pixels and a plurality of second pixel driving circuits are provided in the main display area, and the second pixel driving circuits are configured to drive the second display pixels to emit light, wherein circuit structures of the first pixel driving circuits are different from circuit structures of the second pixel driving circuits, so that an area of the at least one function add-on area occupied by the first pixel driving circuits is less than an area of the main display area occupied by the second pixel driving circuits, wherein an area of the first pixel driving circuits is less than an area of the second pixel driving circuits, and/or a wiring space of the first pixel driving circuits is less than a wiring space of the second pixel driving circuits, and wherein:

a number of components of the first pixel driving circuits is less than a number of components of the second pixel driving circuits, the components of the second pixel driving circuits comprise seven thin film transistors, a storage capacitor, and a light emitting element, the components of the first pixel driving circuits comprise two thin film transistors, a storage capacitor, and a light emitting element, or the components of the first pixel driving circuits comprise four thin film transistors, the storage capacitor, and the light emitting element, or the components of the first pixel driving circuits comprise six thin film transistors, the storage capacitor, and the light emitting element; or a size of the first pixel driving circuits is less than a size of the second pixel driving circuits, and the components of the second pixel driving circuits comprise seven thin film transistors, the storage capacitor, and the light emitting element, and the components of the first pixel driving circuits comprise seven thin film transistors, the storage capacitor, and the light emitting element.

2. The display panel of claim 1, wherein a plurality of signal traces are disposed in the peripheral area of the at least one display transparent area and in the at least one functional additional area, and the signal traces are electrically connected to the first pixel driving circuits, wherein at least two first pixel driving circuits share at least one signal trace and are symmetrical about the at least one signal trace.

3. The display panel of claim 2, wherein the signal traces comprise power signal lines, and the at least two first pixel driving circuits share one power signal line and are symmetrical about the power signal line.

4. A display panel, wherein the display panel comprises a main display area and at least one functional additional area, the at least one function add-on area comprises at least one display transparent area, a plurality of first display pixels are provided in the at least one display transparent area, a plurality of first pixel driving circuits are provided in the at least one function add-on area and correspond to a peripheral area of the at least one display transparent area, and at least one part of the first pixel driving circuits is configured to drive the first display pixels to emit light;

wherein a plurality of second display pixels and a plurality of second pixel driving circuits are provided in the main display area, and the second pixel driving circuits are configured to drive the second display pixels to emit light, wherein circuit structures of the first pixel driving circuits are different from circuit structures of the second pixel driving circuits, so that an area of the at least one function add-on area occupied by the first pixel driving circuits is less than an area of the main display area occupied by the second pixel driving circuits, wherein the first display pixels comprise a first pixel anode, and at least one transparent trace is provided in the at least one display transparent area, wherein the at least one transparent trace is electrically connected to the first pixel anode and the first pixel driving circuits, so that at least part of the first pixel driving circuits is configured to drive the first display pixels to emit light.

5. The display panel of claim 4, wherein an area of the first pixel driving circuits is less than an area of the second pixel driving circuits, and/or a wiring space of the first pixel driving circuits is less than a wiring space of the second pixel driving circuits.

6. The display panel of claim 5, wherein a number of components of the first pixel driving circuits is less than a number of components of the second pixel driving circuits.

7. The display panel of claim 6, wherein components of the second pixel driving circuits comprise seven thin film transistors, a storage capacitor, and a light emitting element; and wherein components of the first pixel driving circuits comprise two thin film transistors, a storage capacitor, and a light emitting element, or the components of the first pixel driving circuits comprise four thin film transistors, a storage capacitor, and a light emitting element, or the components of the first pixel driving circuits comprise six thin film transistors, a storage capacitor, and a light emitting element.

8. The display panel of claim 5, wherein a size of the first pixel driving circuits is less than a size of the second pixel driving circuits.

9. The display panel of claim 8, wherein components of the second pixel driving circuits comprise seven thin film transistors, a storage capacitor, and a light emitting element, and components of the first pixel driving circuits comprise seven thin film transistors, a storage capacitor, and a light emitting element.

10. The display panel of claim 5, wherein a plurality of signal traces are disposed in the peripheral area of the at least one display transparent area and in the at least one functional additional area, and the signal traces are electrically connected to the first pixel driving circuits, wherein at least two first pixel driving circuits share at least one signal trace and are symmetrical about the at least one signal trace.

11. The display panel of claim 10, wherein the signal traces comprise power signal lines, and the at least two first pixel driving circuits share one power signal line and are symmetrical about the power signal line.

12. The display panel of claim 4, wherein the first pixel anode is electrically connected to the first pixel driving circuits by at least one part of the at least one transparent trace provided in the at least one display transparent area, and at least another part of the at least one transparent trace provided in the peripheral area of the at least one display transparent area and in the at least one functional additional area.

13. The display panel of claim 4, wherein the first pixel anode is electrically connected to the first pixel driving circuits by at least one part of the at least one transparent trace provided in the main display area, and at least another part of the at least one transparent trace provided in the peripheral area of the at least one display transparent area and in the at least one functional additional area.

14. A display device, wherein the display device comprises the display panel of claim 4; and a photosensitive element, wherein the photosensitive element is disposed at one side of the display panel and corresponds to the at least one functional additional area.

* * * * *